US008675895B2

(12) United States Patent
Høvesten et al.

(10) Patent No.: US 8,675,895 B2
(45) Date of Patent: Mar. 18, 2014

(54) MICROPHONE ASSEMBLY WITH INTEGRATED SELF-TEST CIRCUITRY

(75) Inventors: Per Flemming Høvesten, Måløv (DK); Jens Kristian Poulsen, Kitchener (CA); Gino Rocca, Copenhagen V (DK)

(73) Assignee: Epcos Pte Ltd, Singapore (SG)

( * ) Notice: Subject to any disclaimer, the term of this patent is extended or adjusted under 35 U.S.C. 154(b) by 520 days.

(21) Appl. No.: 12/935,636

(22) PCT Filed: Apr. 8, 2009

(86) PCT No.: PCT/EP2009/054202
§ 371 (c)(1),
(2), (4) Date: Jan. 18, 2011

(87) PCT Pub. No.: WO2009/127568
PCT Pub. Date: Oct. 22, 2009

(65) Prior Publication Data
US 2011/0110536 A1 May 12, 2011

Related U.S. Application Data

(60) Provisional application No. 61/124,208, filed on Apr. 15, 2008.

(51) Int. Cl.
*H04R 3/00* (2006.01)

(52) U.S. Cl.
USPC ..... 381/113; 381/111

(58) Field of Classification Search
USPC ..... 381/92, 60, 73.1, 58, 55, 111–114, 174, 381/122, 123; 324/702, 379; 330/324, 327
See application file for complete search history.

(56) References Cited

U.S. PATENT DOCUMENTS

2006/0008097 A1 * 1/2006 Stenberg et al. ..... 381/113

FOREIGN PATENT DOCUMENTS

EP 1599067 A2 11/2005
JP 2006-054892 A 2/2006
WO 01/78446 A1 10/2001

OTHER PUBLICATIONS

Japanese Examination Report corresponding to co-pending Japanese Patent Application No. 2011-504423, Japan Patent Office, dated Apr. 9, 2013; (3pages).
Written Opinion corresponding to International Patent Application No. PCT/EP2009/054202, European Patent Office, dated Jul. 3, 2009, 5 pages.
International Search Report corresponding to International Patent Application No. PCT/EP2009/054202, European Patent Office, dated Jul. 3, 2009, 3 pages.
Bin Liu et al. "A New Measurement Microphone Based on MEMS Technology"; Journal of Microelectromechanical Systems, vol. 12, No. 6, pp. 880-891; (dated Dec. 1, 2003) XP011105270.

* cited by examiner

*Primary Examiner* — Vivian Chin
*Assistant Examiner* — Ammar Hamid
(74) *Attorney, Agent, or Firm* — Nixon Peabody LLP

(57) ABSTRACT

The present invention relates to a condenser microphone assembly comprising an electro-acoustic transducer element comprising a diaphragm and a back plate, signal processing circuitry operatively connected to the transducer element so as to process signals generated by the transducer element, and a mode-setting circuitry for selectively setting the condenser microphone assembly in a test mode or an operational mode. The electro-acoustic sensitivity of the condenser microphone assembly, when operated in the test mode, is at least 40 dB lower than the corresponding electro-acoustic sensitivity of the assembly when operated in the operational mode. The present invention further relates to a method for determining a performance parameter of a signal processing circuitry mounted inside a housing of an assembled condenser microphone assembly.

24 Claims, 3 Drawing Sheets

MICROPHONE ASSEMBLY WITH INTEGRATED SELF-TEST CIRCUITRY

CROSS-REFERENCE TO RELATED APPLICATIONS

This application is a U.S. National Stage of International Application No. PCT/EP2009/054202, filed Apr. 8, 2009, which claims the benefit of U.S. Provisional Application No. 61/124,208, filed on Apr. 15, 2008, both of which are incorporated herein by reference in their entireties.

FIELD OF THE INVENTION

The present invention relates to a miniature microphone assembly and a method for measuring selected performance parameters of a signal processing circuitry of such a miniature microphone assembly. In particular, the present invention relates to a miniature microphone assembly comprising an integrated diagnostic or test circuitry for separating electric signals generated by the signal processing circuitry from signals generated by a microphone transducer element operatively connected to the signal processing circuitry.

BACKGROUND OF THE INVENTION

Sensitive analog circuits, such as low-noise miniature microphone preamplifiers, are generally difficult to test during wafer manufacturing due to electromagnetic and acoustical noisy and hostile fabrication environments. It is therefore advantageous to measure performance parameters of a signal processing circuitry during a final test of the assembled microphone assembly. Also, due to variability during production of miniature microphones assemblies for portable terminals and hearing instruments, it is advantageous to measure performance parameters on the assembled microphone assembly to ensure compliance with electrical and/or electro-acoustical specifications. Electro-acoustic sensitivity (Volt/Pascal) and electrical output noise level of a low-noise miniature microphone preamplifier are examples of such performance parameters.

However, measurements of the performance parameters are typically influenced by an interaction and combination of signals generated by a microphone transducer element of the assembly, and signals generated by a signal processing circuitry involving circuitries such as preamplifiers, voltage regulators, voltage multipliers etc. In order to measure performance, parameters of the assembly the signals processed or generated by the signal processing circuitry need to be separated from signals generated by the microphone transducer element.

Thus, it may be seen as an object of the present invention to provide an integrated diagnostic or test circuitry for separating the signals generated by the signal processing circuitry from signals generated by the microphone transducer element. By doing this, accurate identification of a failing component or part of a rejected miniature microphone assemblies is possible and the failing component can be redesigned or modified as appropriate.

DESCRIPTION OF THE INVENTION

The above-mentioned object is complied with by providing, in a first aspect, a condenser microphone assembly comprising an electro-acoustic transducer element, signal processing circuitry, and mode-setting circuitry. The electro-acoustic transducer element comprises a diaphragm and a back plate. The signal processing circuitry is operatively connected to the transducer element so as to process signals generated by the transducer element. The mode-setting circuitry selectively sets the condenser microphone assembly in a test mode or an operational mode. An electro-acoustic sensitivity of the condenser microphone assembly, when operated in the test mode, is at least 40 dB lower than the corresponding electro-acoustic sensitivity of the assembly when operated in the operational mode.

The test mode of the assembly facilitates that digital or analog miniature condenser microphone assemblies may be sorted into different groups, such as for example "Approved", "Rejected", "A quality" and "B quality". The test mode enables accurate and fast measurements of the output noise level in an industrial environment involving high environmental noise levels. Thus, according to the present invention, there is no need for anechoic test environments. In this way, automated tests of noise performance can be performed in a fast and cost-effective manner in connection with normal electrical tests.

The test mode allows selective measurement and assessment of signals generated by the signal processing circuitry without influence from signals generated by the electro-acoustic transducer element. By doing this accurate identification of a failing component or part of a rejected miniature microphone assemblies is facilitated. As explained in greater detail later, the test mode facilitates measurements of the performance or electrical characteristics of the signal processing circuitry, typically arranged on a semiconductor die in the form of an ASIC, on the finished condenser microphone assembly.

Particular embodiments of the present invention comprise electro-acoustic capacitive transducer elements of the electret types or non-electret types (the latter type requiring an external DC bias voltage) or a combination of both.

Preferably, the electro-acoustic transducer element is a MEMS microphone transducer element.

The condenser microphone assembly, when operated in the test mode, preferably has an electro-acoustic sensitivity which is at least 50 dB, such as 60 dB, such as 70 dB, such as 80 dB, lower than the electro-acoustic sensitivity of the condenser microphone assembly when operated in the operational mode.

The condenser microphone assembly may further comprise a voltage multiplier for generating a DC bias voltage. The DC bias voltage is applied as a DC voltage difference between the diaphragm and the back plate. The voltage multiplier may be implemented as a Dickson voltage pump generating a DC bias voltage within the range 5-20V such as between 8-12V, such as approximately 10V.

Preferably, the signal processing circuitry, the mode setting circuitry, and the voltage multiplier are provided on a common semiconductor die or substrate, for example, in the form of a CMOS, bipolar or BiCMOS ASIC. Optionally, the semiconductor die may further comprise a MEMS fabricated electro-acoustic transducer element to provide a single die MEMS condenser microphone assembly.

The mode-setting circuitry of the condenser microphone assembly may comprise an electronic switch adapted to electrically disconnecting the transducer element from the signal processing circuitry. Moreover, a capacitor may be provided that is electrically connected to the signal processing circuitry when the condenser microphone assembly is operated in the test mode. Preferably, the provided capacitor has a capacitance essentially equal to a capacitance formed by diaphragm and the back plate structures of the electro-acoustic transducer element. The capacitor preferably couples to the signal processing circuitry in a manner that keeps a signal source capacitance as "seen" by the signal processing circuitry in the test mode essentially identical to the transducer capacitance in the operational mode. This allows performance characteristics of the signal processing circuitry, for example a preamplifier, to be tested under realistic operational conditions, i.e., with a signal source impedance substantially identical to that of the operational mode.

The mode-setting circuitry of the condenser microphone assembly may further comprise nullifying circuitry adapted to set the DC bias voltage between the diaphragm and the back plate to 0 Volt. To comply with this, the nullifying circuitry may comprise a short circuiting device adapted to electrically ground an output port of the voltage multiplier connected to the diaphragm or the back plate of the electro-acoustic transducer element.

Moreover, the mode-setting circuitry of the condenser microphone assembly may comprise a nullifying circuitry adapted for zeroing the DC bias voltage in response to a control signal provided to the voltage multiplier. The control signal preferably comprises a clock signal or a DC input signal or a combination thereof applied to the voltage multiplier.

The condenser microphone assembly facilitates that a supply voltage level and/or current supply level to the signal processing circuitry may be essentially independent of a mode-setting of the assembly. In particular, a supply voltage level or current supply level to a preamplifier circuitry of the signal processing circuitry may be essentially independent of a mode-setting of the assembly. Thus, an essentially constant supply voltage and/or an essentially constant current may be applied to the signal processing circuitry in both the test mode and the operationally mode. This allows the performance characteristics of the preamplifier circuitry to be tested under realistic operational conditions, i.e. with supply voltage and current settings substantially identical to those of the operational mode.

In a second aspect, the present invention relates to a method for determining a performance parameter of a signal processing circuitry mounted inside a housing of a condenser microphone assembly. The condenser microphone assembly comprises an electro-acoustic transducer element having a diaphragm and a back plate, signal processing circuitry operatively connected to the transducer element so as to process signals generated by the transducer element, and mode setting circuitry for selectively setting a mode of operation of the condenser microphone assembly. The method comprising the steps of setting the condenser microphone assemble in the test mode of operation and providing test data to the signal processing circuitry of the condenser microphone assembly. The method further includes determining, on the basis of the provided test data, a performance parameter of the signal processing circuitry of the condenser microphone assembly while the condenser microphone assembly is operated in the test mode. The condenser microphone assembly, when operated in the test mode, has an electro-acoustical sensitivity that is at least 40 dB lower than the corresponding electro-acoustic sensitivity of the condenser microphone assembly when operated in an operational mode.

Again, the condenser microphone assembly, when operated in the test mode, preferably has an electro-acoustic sensitivity which is at least 50 dB, such as 60 dB, such as 70 dB, such as 80 dB, lower than the electro-acoustic sensitivity of the condenser microphone assembly when operated in the operational mode.

The step of setting the condenser microphone assembly in the test mode may involve electrically disconnecting the electro-acoustic transducer element from the signal processing circuitry. Moreover, the step of setting the condenser microphone assembly in the test mode may further comprise the step of electrically connecting the signal processing circuitry to a capacitor having a capacitance essentially equal to a capacitance formed by the diaphragm and the back plate of the electro-acoustic transducer element.

The step of setting the condenser microphone assembly in the test mode may involve zeroing of a bias voltage applied between the diaphragm and the back plate. The bias voltage may be zeroed by electrically connecting an output port of a voltage multiplier to ground. Alternatively, the bias voltage may be zeroed in response to a control signal provided to a voltage multiplier.

The method facilitates that a supply voltage level to the signal processing circuitry may be essentially independent of a mode-setting of the assembly. In particular, a supply voltage level to a preamplifier circuitry of the signal processing circuitry may be essentially independent of a mode-setting of the assembly. Thus, an essentially constant supply voltage and/or an essentially constant current may be applied to the signal processing circuitry in both the test mode and the operationally mode.

BRIEF DESCRIPTION OF THE DRAWINGS

Various embodiments of the present invention will now be described in further details with reference to the accompanying figures, wherein.

Figure 1:
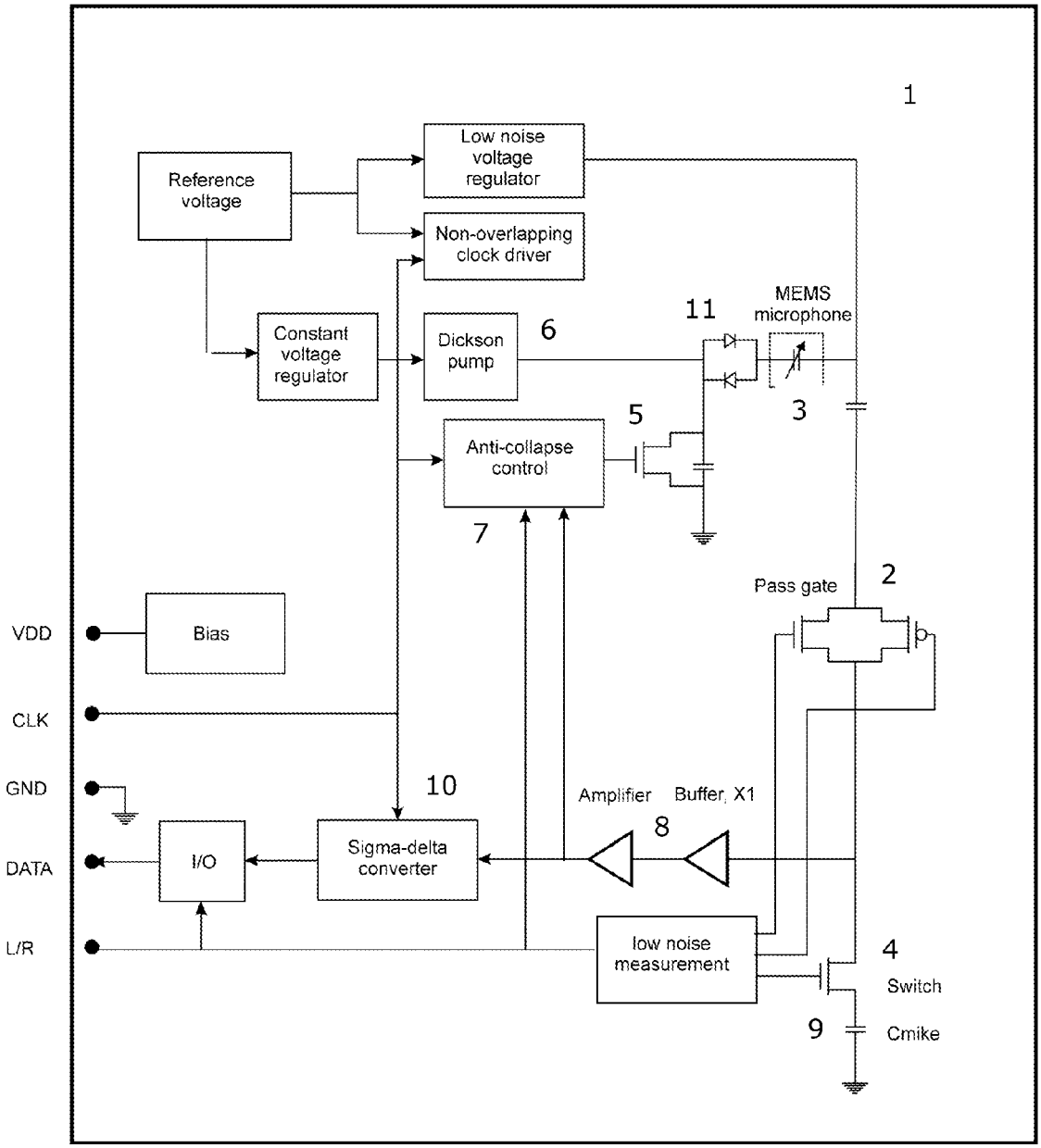
FIG. 1 shows a miniature microphone assembly according to a first embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE DRAWINGS

In its broadest aspect the present invention relates to a miniature microphone assembly and an associated method whereby the miniature microphone assembly can be set in a test mode by transmitting data, such as digital data, through a mode setting interface of the microphone assembly. The digital data may be provided by external means, such as a test computer.

While being in the test mode, the electro-acoustic sensitivity of the miniature microphone assembly is at least 40 dB lower than the corresponding electro-acoustic sensitivity of the assembly when operated in an operational mode.

The test mode makes it possible to selectively measure the performance or electrical characteristics of the signal processing circuitry, which typically involves an ASIC, on a finished miniature microphone assembly. By putting the assembly in the test mode, performance parameters of the signal processing circuitry can be measured after its mounting inside a microphone housing or microphone package. Furthermore, the present invention also enables performance tests of noise levels of miniature microphones assemblies in a non-anechoic environment. This is an advantage since anechoic environments are very impractical to implement in a mass-production oriented industrial environment.

An electric output signal from a microphone transducer element of a non-electret condenser microphone depends on a DC bias voltage applied between a diaphragm and a back-plate forming a transducer capacitor in combination. If there is no DC bias voltage applied between the diaphragm and the back-plate, the electro-acoustic sensitivity will be virtually zero to applied sound signals. Under these conditions, the electric output signal from a miniature microphone assembly is largely determined by electronic noise from the signal processing circuitry operatively connected to the microphone transducer element. In this situation, it is possible to determine the intrinsic noise level of the microphone transducer element and the noise contribution by the signal processing circuitry themselves without placing the miniature microphone assembly in an acoustically isolated environment, such as inside an anechoic/sound proof acoustic chamber. To further enhance the reliability and accuracy of the noise measurement, the signal processing circuitry may, for testing purposes, be programmed or set to a higher small-signal gain than the small-signal gain of the operational mode, such as an additional gain of 10-40 dB.

It should be noted that, in addition to the electronic noise from the signal processing circuitry, there will be an acoustical-electrical noise contribution from the microphone transducer element. However, the magnitude of this acoustical-electrical noise can be estimated (either based on measurements or using an average value) and, thus, a reliable estimate of the output noise level of the finished miniature microphone assembly can be obtained even in an acoustically noisy industrial production environment.

In addition to determining the noise level of the signal processing circuitry, it is also possible to determine the small-signal or AC-amplification of the signal processing circuitry by introducing a well-defined low level AC-signal in the signal path when the DC bias voltage between the diaphragm and back-plate has been nullified.

Referring now to FIG. 1, a simplified schematic of a digital miniature microphone assembly 1 comprising, among other elements, a signal processing circuitry is depicted. The assembly comprises a programmable electronic switch 2, for example in the form of one or more MOS or CMOS transistors, inserted between the input of a low-noise microphone preamplifier/buffer 8 and a microphone transducer element 3, and a second programmable switch 4 inserted between the input terminal of the preamplifier/buffer 8 and AC-ground. A third programmable switch 5 is provided for nullifying a DC bias voltage from the Dickson pump 6. This third programmable electronic switch 5 is controlled by a collapse detection circuitry 7 which detects and/or prevents the occurrence of permanent sticktion between a microphone transducer diaphragm and back-plate structures due to nonlinear attractive electrostatic forces.

The microphone transducer element shown in FIG. 1 is non-electret type MEMS microphone transducer element. However, the embodiment depicted in FIG. 1 can also be implemented with electret microphone transducer elements thus omitting the Dickson pump and the collapse detection circuitry.

One of the programmable switches 4 is arranged to couple the input terminal of the preamplifier/buffer 8 to AC-ground through a capacitor Cmike 9, while the other programmable switches 2 are arranged to disconnect the input of the low-noise microphone preamplifier/buffer 8 from the microphone transducer element 3. The capacitance of the capacitor Cmike 9 is preferably substantially identical to the capacitance of the microphone transducer element. Thus, when the miniature microphone assembly of FIG. 1 is operated in the test mode noise contribution from the microphone transducer element is substantially eliminated by either switching the connection between the microphone transducer element and the input node of the signal processing circuitry off by deactivating an intermediately positioned pass gate switch 2 or by connecting the input node of the signal processing circuitry to AC-ground. The latter can be accomplished by coupling the input node to small-signal or AC ground, for example, by coupling the input node to a ground terminal or DC supply voltage terminal through the above-mentioned capacitor, Cmike. In this manner, one terminal of Cmike is coupled to small-signal or AC ground. Cmike may advantageously have a nominal capacitance substantially identical to the capacitance of the microphone transducer element. As an alternative, Cmike may have a nominal capacitance within +/−25% of the capacitance of the microphone transducer element. Depending on the nominal value of the capacitance of the microphone transducer element, the capacitance of Cmike is preferably between 0.5 pF and 20 pF for miniature condenser microphone assemblies suitable for use in mobile terminals and hearing prostheses. The capacitor, Cmike, may advantageously be integrated on a semiconductor die or chip together with the signal processing circuitry and the mode setting circuitry and may comprise a poly-poly capacitor.

In a preferred embodiment, the mode-setting circuitry in accordance with the present invention is combined with collapse detection circuitry described in applicant's co-pending EP application No. EP 1 599 067, which is incorporated by reference in its entirety. This latter circuitry detects and/or prevents the occurrence of permanent sticktion between a MEMS microphone diaphragm and back-plate structures due to nonlinear attractive electrostatic forces. The collapse detection circuitry preferably comprises a DC bias voltage nullification function adapted to eliminate the nonlinear attractive electrostatic forces between the diaphragm and back-plate structures and thus avoid sticktion problems. The DC bias voltage nullification function is in FIG. 1 implemented as programmable MOS switch 5 that is capable of short-circuiting an output of the Dickson pump and the DC bias voltage capacitor. The nullification function 5 of the collapse detection circuitry is capable of nullifying the DC bias voltage, i.e. bringing the DC bias voltage to substantially zero volt, very rapidly.

The DC bias voltage nullification function may serve two different purposes in this particular embodiment of the miniature microphone assembly. One purpose is a collapse detection/prevention function. Another purpose is an arrangement for bringing the assembly into a test mode.

Still referring to FIG. 1, an A/D converter 10 in the form of a sigma-delta converter is provided to convert the analog preamplifier signal to a digital output signal from the assembly. A pair of cross-coupled diodes 11 having an impedance in the TΩ or GΩ range are inserted between the output node of the Dickson pump 6 and the back-plate or diaphragm structure of miniature transducer element 3 to provide an essentially constant charge state of the transducer element.

The illustrated programming interface comprises Data, Clock and ground lines and it may be a customized/proprietary or an industry-standard type of programming interface. The programming interface is preferably a bi-directional interface, such as a bi-directional IIC bus interface that supports transmission of data from the A/D converter 10 and receipt of data transmitted to the assembly from for example a test computer adapted to configure the assembly for test mode operation. The programming interface may alternatively comprise a one-wire digital data interface with a single data line and ground line. According to another embodiment of the invention, the programming interface comprises Serial Low-power Inter-chip Media Bus (SLIMbus™) in accordance with the specification of the MIPI alliance.

In the embodiment depicted in FIG. 1, the Dickson pump 6 generates a DC bias voltage of around 10V which is applied, via the pair of cross-coupled diodes 11, as a voltage difference between the diaphragm and the back-plate of the miniature transducer element 3. In case of an electret miniature transducer element having incorporated charges so as to generate the required voltage difference between the diaphragm and back-plate, the programmable switches 2 inserted between the input of a low-noise microphone preamplifier/buffer 8 and the microphone transducer element 3, and the programmable switch 4 inserted between the input terminal of the preamplifier/buffer 8 and AC-ground, are applicable for bringing an electret miniature microphone assembly into a test mode.

When the miniature microphone assembly shown in FIG. 1 has been set into the test mode signals generated by the signal processing circuitry is separated from signals generated by the microphone transducer element. In this way, failing miniature microphone assemblies can be accurately identified by passing appropriate data signals through the signal processing circuitry of the assemblies.

Figure 2:
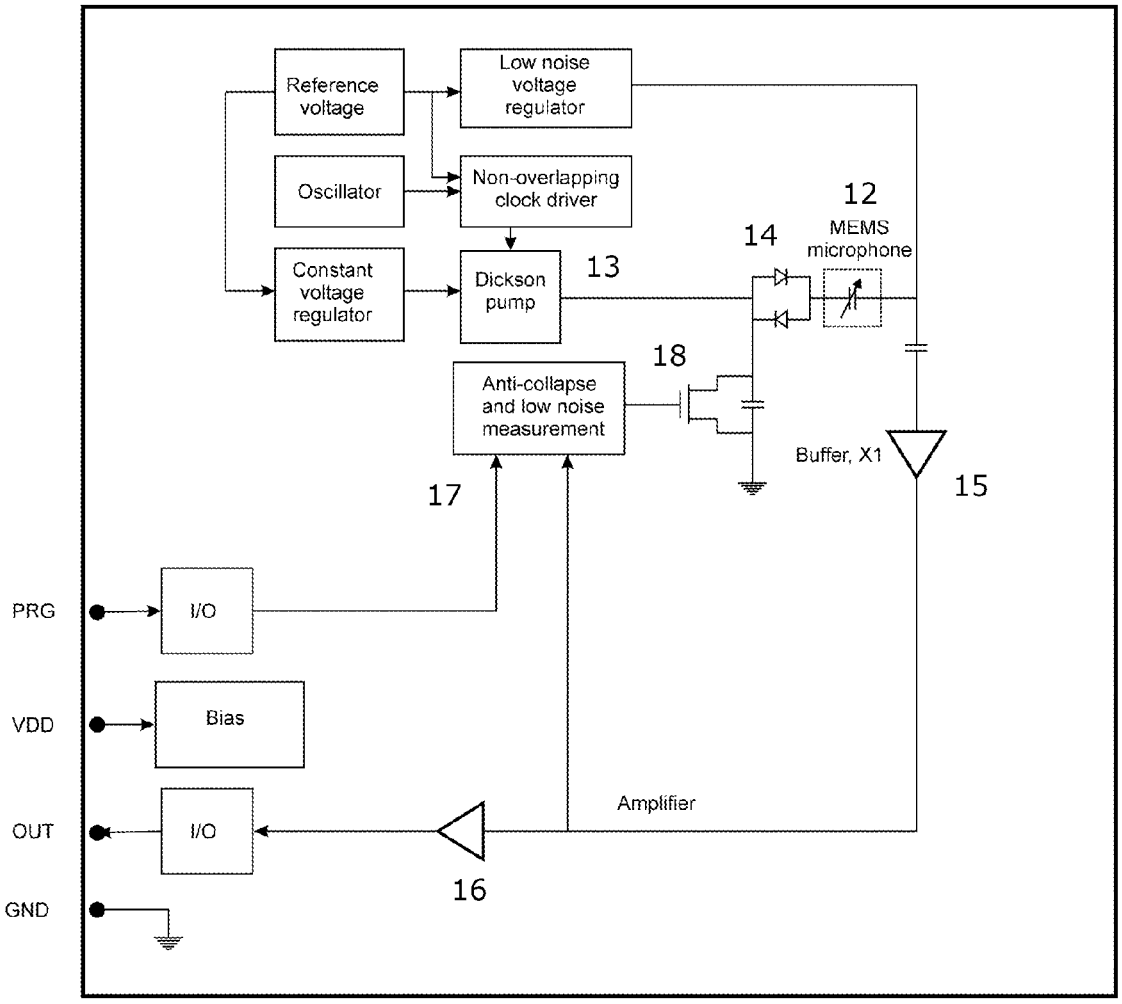
FIG. 2 shows a miniature microphone assembly according to a second embodiment of the present invention.

Referring now to FIG. 2, an analog miniature microphone assembly according to a second embodiment of the present invention is depicted. The assembly of FIG. 2 applies a non-electret miniature transducer element 12 comprising a diaphragm and a back-plate operatively connected to a Dickson pump 13. The Dickson pump 13 generates a bias voltage of around 10V which is applied, via a pair of cross-coupled diodes 14, as a voltage difference between the diaphragm and the back-plate of the miniature transducer element 12. The electric output signal from the transducer element is passed through a buffer 15 and a low-noise preamplifier 16 before reaching an output node of the assembly.

A collapse detection circuitry 17 for detecting and/or preventing the occurrence of permanent sticktion between the diaphragm and back-plate structures is provided. The collapse detection circuitry comprises a DC bias voltage nullification function 18 adapted to eliminate the nonlinear attractive electrostatic forces between the diaphragm and back-plate structures and thus avoid sticktion problems. Thus, the DC bias voltage nullification function 18 is adapted to connect the DC bias voltage from the Dickson pump 13 to ground, and thereby nullify the voltage difference between the diaphragm and the back-plate. The nullification function 18 of the collapse detection circuitry is capable nullifying the DC bias voltage, i.e. bringing the DC bias voltage to zero, very rapidly.

When miniature microphone assemblies as shown in FIG. 2 are brought into the test mode by short circuiting the Dickson pump, failing assemblies can be accurately identified by passing appropriate data/test signals through the signal processing circuitry of the assemblies.

Figure 3:
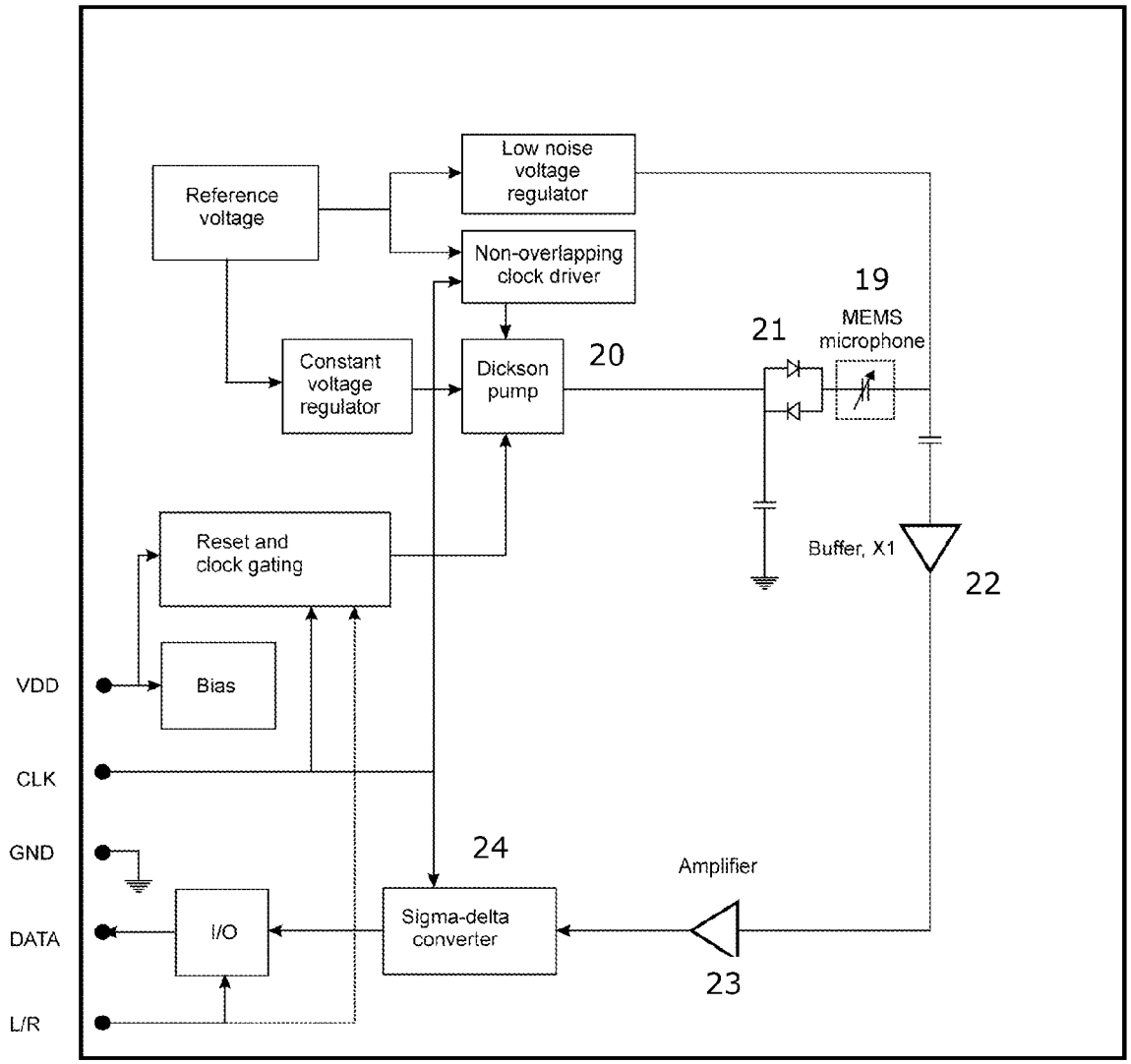
FIG. 3 shows a miniature microphone assembly according to a third embodiment of the present invention.

Referring now to FIG. 3 a digital miniature microphone assembly according to a third embodiment of the present invention is depicted. The assembly of FIG. 3 applies a non-electret miniature transducer element 19 comprising a diaphragm and a back-plate operatively connected to a Dickson pump 20. The Dickson pump 20 generates a bias voltage of around 10V which is applied, via a pair of cross-coupled diodes 21, as a voltage difference between the diaphragm and the back-plate of the miniature transducer element 19. The electric output signal from the transducer element is passed through a buffer 22 and a low-noise preamplifier 23 before reaching an A/D converter 24 in the form of a sigma-delta converter.

The output voltage from the Dickson pump is controlled either by removing its clock signal or by reducing a DC input voltage that is applied to the Dickson pump. Thus, to nullify the DC bias voltage from the Dickson pump in order to bring the miniature microphone assembly of FIG. 3 into a test mode, the clock signal or the DC input voltage can be removed from the Dickson pump. When assemblies as shown in FIG. 3 have been brought into the test mode, failing assemblies can be accurately identified by passing appropriate data/test signals through the signal processing circuitry of the assemblies.

In any one of the embodiments depicted in FIGS. 1-3, the small-signal or AC amplification of the signal processing circuitry can be measured or determined by disabling DC bias voltage and introducing a well-defined low level signal to the signal processing circuitry. This low level signal may be produced by switching a reference voltage on/off (preferably a 1.2V band-gap voltage) with a suitable frequency. The suitable frequency can be derived for example by downscaling a master or main clock signal. Moreover, the reference voltage may be scaled to a suitable magnitude by using either resistive and/or capacitive scaling circuits that can maintain high accuracy despite semiconductor process variation. This may be used for self-test or during production test for finding the absolute sensitivity of the microphone.

Additionally, embodiments of the present invention facilitate that one or more of the following tests can be performed:

1. Microphone capacitance-bias voltage test
2. Microphone bias test
3. Input leak test
4. The 1 kHz amplification/sensitivity Microphone Capacitance-Voltage Test The aim of this test is to avoid collapse of the diaphragm and the back-plate of the microphone assembly. If the charge-pump/Dickson pump is designed as a fast settling, feedback regulated pump, its reference voltage can be made accessible by the exterior of the microphone assembly so that the internal charge-pump voltage can be overridden by an external, analog voltage. Thereby the internal charge-pump voltage used to bias the microphone element can be varied continuously in a controlled way over a predefined range of voltages. If the sensitivity of the microphone is measured for various charge-pump voltages (controlled by an externally set reference voltage), a sensitivity vs. reference voltage/bias voltage relation can be determined for the microphone assembly. This relation can be transformed to a capacitance-bias voltage relation if desired.

The reference voltage to the charge-pump can also be set by a One Time Programming (OTP) bit pattern providing a range of fixed but different reference voltages. This embodiment replaces an additional external connection for applying a reference voltage assuming OTP facilities are already implemented.

Microphone Bias Test

The aim of this test is to obtain information about the leakage current passing around the transducer of the microphone assembly. A reverse biased diode string acting as a voltage divider can tap the output of the charge-pump/Dickson pump. The divided output voltage can be brought out on a special pin for external monitoring through a Tera Ohm input impedance analog buffer, or converted by a simple A/D converter to a suitable digital format and output as a serial digital bit stream on the microphone assembly data output pin when enabled by OTP setting.

Input Leak Test

The input leak level can be tested by on-chip measurement of the voltage difference occurring over the final output low pass filters cross coupled series diodes attached to the charge-pump. The diode voltage drop is logarithmic in that is roughly follows $$V_t = Ln\frac{I_{leak}}{I_s}$$

Due to the logarithmic behavior of $V_t$ the sensitivity of the microphone assembly to very small leakage currents are high. The diode voltage difference can either be brought out of the microphone assembly through a Tera Ohm input impedance buffer or converted by a simple A/D converter and output through the data output when OTP enabled.

The 1 kHz Amplification/Sensitivity Test

The aim of this test is to get information about the gain of the ASIC of the microphone assembly. An internal bandwidth limited square wave generator outputting its signal at the system clock frequency divided by say $$\frac{2.4\text{ MHz}}{2^{11}} = 1.17\text{ kHz}$$

and with a well defined mV level scaled by a resistor division of the internal reference voltage VDD, can be inserted at the membrane side of the transducer element via an on-chip VDD regulator. The corresponding system output is then a measure of the overall signal path gain.

The invention claimed is:

1. A condenser microphone assembly comprising:

an electro-acoustic transducer element comprising a diaphragm and a back plate;

signal processing circuitry operatively connected to the transducer element so as to process signals generated by the transducer element; and mode-setting circuitry for selectively setting the condenser microphone assembly in a test mode or an operational mode, wherein the test mode allows provision of test data to the signal processing circuitry to determine a performance parameter, and wherein an electro-acoustic sensitivity of the condenser microphone assembly, when operated in the test mode, is at least 40 dB lower than the corresponding electro-acoustic sensitivity of the assembly when operated in the operational mode.

2. A condenser microphone assembly according to claim 1, wherein the condenser microphone assembly, when operated in the test mode, has an electro-acoustic sensitivity being at least 50 dB, or at least 60 dB, or at least 70 dB, or at least 80 dB, lower than the electro-acoustic sensitivity of the condenser microphone assembly when operated in the operational mode.

3. A condenser microphone assembly according to claim 1, further comprising a voltage multiplier for generating a DC bias voltage, said DC bias voltage being applied as a DC voltage difference between the diaphragm and the back plate.

4. A condenser microphone assembly according to claim 3, wherein the signal processing circuitry, the mode setting circuitry, and the voltage multiplier is provided on a common semiconductor die.

5. A condenser microphone assembly according to claim 4, wherein the semiconductor die further comprises the electro-acoustic transducer element.

6. A condenser microphone assembly according to claim 1, wherein the electro-acoustic transducer element comprises an electret transducer element.

7. A condenser microphone assembly according to claim 1, wherein the mode-setting circuitry comprises an electronic switch adapted to electrically disconnecting the transducer element from the signal processing circuitry.

8. A condenser microphone assembly according to claim 7, further comprising a capacitor, said capacitor being electrically connected to the signal processing circuitry when the condenser microphone assembly is operated in the test mode.

9. A condenser microphone assembly according to claim 8, wherein the capacitor has a capacitance essentially equal to a capacitance formed by the diaphragm and the back plate of the electro-acoustic transducer element.

10. A condenser microphone assembly according to claim 3, further comprising nullifying circuitry adapted to set the DC bias voltage between the diaphragm and the back plate to 0 Volt.

11. A condenser microphone assembly according to claim 10, wherein the nullifying circuitry comprises short circuiting device adapted to electrically connect an output port of the voltage multiplier to ground.

12. A condenser microphone assembly according to claim 10, wherein the nullifying circuitry comprises means for zeroing the DC bias voltage in response to a control signal provided to the voltage multiplier.

13. A condenser microphone assembly according to claim 1, wherein a voltage supply level and/or current supply level to the signal processing circuitry is independent of a mode-setting of the assembly.

14. A condenser microphone assembly according to claim 13, wherein a supply voltage level to a preamplifier circuitry of the signal processing circuitry is independent of a mode-setting of the assembly.

15. A method for determining a performance parameter of a signal processing circuitry mounted inside a housing of a condenser microphone assembly, the condenser microphone assembly comprising an electro-acoustic transducer element comprising a diaphragm and a back plate, signal processing circuitry operatively connected to the transducer element so as to process signals generated by the transducer element, and mode setting circuitry for selectively setting a mode of operation of the condenser microphone assembly, the method comprising:

setting the condenser microphone assemble in the test mode of operation;

providing test data to the signal processing circuitry of the condenser microphone assembly; and determining, on the basis of the provided test data, a performance parameter of the signal processing circuitry of the condenser microphone assembly while the condenser microphone assembly is operated in the test mode; and wherein the condenser microphone assembly, when operated in the test mode, has an electro-acoustical sensitivity being at least 40 dB lower than the corresponding electro-acoustic sensitivity of the condenser microphone assembly when operated in an operational mode.

16. A method according to claim 15, wherein the condenser microphone assembly, when operated in the test mode, has an electro-acoustic sensitivity being at least 50 dB, such as 60 dB, such as 70 dB, such as 80 dB, lower than the electro-acoustic sensitivity of the condenser microphone assembly when operated in the operational mode.

17. A method according to claim 15, wherein the setting the condenser microphone assembly in the test mode includes electrically disconnecting the electro-acoustic transducer element from the signal processing circuitry.

18. A method according to claim 17, wherein the setting the condenser microphone assembly in the test mode further comprises the step of electrically connecting the signal processing circuitry to a capacitor.

19. A method according to claim 18, wherein the capacitor has a capacitance essentially equal to a capacitance formed by the diaphragm and the back plate of the electro-acoustic transducer element.

20. A method according to claim 16, wherein the setting the condenser microphone assembly in the test mode includes zeroing of a bias voltage applied between the diaphragm and the back plate.

21. A method according to claim 20, wherein the bias voltage is zeroed by electrically connecting an output port of a voltage multiplier to ground.

22. A method according to claim 20, wherein the bias voltage is zeroed in response to a control signal provided to a voltage multiplier.

23. A method according to claim 15, wherein a voltage supply level and/or current supply level to the signal processing circuitry is independent of a mode-setting of the assembly.

24. A method according to claim 23, wherein a supply voltage level to a preamplifier circuitry of the signal processing circuitry is independent of a mode-setting of the assembly.

* * * * *

UNITED STATES PATENT AND TRADEMARK OFFICE

CERTIFICATE OF CORRECTION

PATENT NO. : 8,675,895 B2
APPLICATION NO. : 12/935636
DATED : March 18, 2014
INVENTOR(S) : Per Flemming Høvesten, Jens Kristian Poulsen and Gino Rocca It is certified that error appears in the above-identified patent and that said Letters Patent is hereby corrected as shown below:

On the Title Page, Item (75) Inventors, please change the city for Inventor Per Flemming Høvesten to "Ballerup (DK)."

On the Title Page, Item (75) Inventors, please change the city for Inventor Jens Kristian Poulsen to "Hedehusene (DK)."

Signed and Sealed this
Twenty-second Day of July, 2014

Michelle K. Lee

Michelle K. Lee
*Deputy Director of the United States Patent and Trademark Office*